US005101890A

United States Patent [19]

Aoki et al.

[11] Patent Number: 5,101,890

[45] Date of Patent: Apr. 7, 1992

[54] HEAT EXCHANGER

[75] Inventors: Hisao Aoki, Maebashi; Kazuhiro Nakaguro, Isesaki, both of Japan

[73] Assignee: Sanden Corporation, Gunma, Japan

[21] Appl. No.: 513,689

[22] Filed: Apr. 24, 1990

[30] Foreign Application Priority Data

Apr. 24, 1989 [JP] Japan ..... 1-46792[U]
Jun. 2, 1989 [JP] Japan ..... 1-64020[U]

[51] Int. Cl.[5] ..... F28D 1/053
[52] U.S. Cl. ..... 165/152; 165/175
[58] Field of Search ..... 165/110, 147, 150, 152, 165/153, 175, 903

[56] References Cited

U.S. PATENT DOCUMENTS

| | | | |
|---|---|---|---|
| D. 304,856 | 11/1989 | Aoki | D23/386 |
| 1,834,070 | 12/1931 | Parkinson | 165/175 |
| 1,853,314 | 4/1932 | Modine | 165/175 |
| 1,944,056 | 1/1934 | Baer | 165/175 |
| 2,883,165 | 4/1959 | Jensen et al. | 165/150 |
| 3,897,821 | 8/1975 | Babunovic et al. | 165/175 |
| 4,337,224 | 6/1982 | Mahler et al. | 165/175 |
| 4,570,700 | 2/1986 | Ohara et al. | 165/170 |
| 4,587,701 | 3/1986 | Koisuka et al. | 29/890.035 |
| 4,615,383 | 10/1986 | Hisao | 165/152 |
| 4,620,590 | 11/1986 | Koisuka et al. | 165/150 |
| 4,676,304 | 6/1987 | Koisuka et al. | 165/146 |
| 4,678,112 | 7/1987 | Koisuka et al. | 228/138 |
| 4,716,959 | 1/1988 | Aoki | 165/152 |
| 4,745,967 | 5/1988 | Kern | 165/153 |
| 4,749,627 | 6/1988 | Ishikawa et al. | 428/654 |
| 4,771,942 | 9/1988 | Arold et al. | 165/176 |
| 4,825,941 | 5/1989 | Hoshino et al. | 165/110 |
| 4,901,792 | 2/1990 | Komiya | 165/175 |
| 4,969,512 | 11/1990 | Aoki et al. | 165/152 |
| 4,977,956 | 12/1990 | Aoki et al. | 165/176 |

FOREIGN PATENT DOCUMENTS

| | | | |
|---|---|---|---|
| 736074 | 4/1943 | Fed. Rep. of Germany | 165/175 |

*Primary Examiner*—John Rivell
*Assistant Examiner*—L. R. Leo
*Attorney, Agent, or Firm*—Banner, Birch, McKie & Beckett

[57] ABSTRACT

A heat exchanger includes a pair of header pipes, a plurality of flat heat-transfer tubes parallel to each other, a plurality of radiation fins provided on the sides of the flat heat-transfer tubes, an additional flat heat-transfer tube disposed adjacent to the end flat heat-transfer tube, having a path cross-sectional area larger than those of the flat heat-transfer tubes and being connected to one of the header pipes and a joint unit, and an additional radiation fin provided on at least one side of the additional flat heat-transfer tube. The vacant space in the space for installation of the heat exchanger can be utilized as an additional heat exchange portion formed by the additional tube and fin; and the effectiveness of the heat exchanger can be efficiently increased even if the space for the installation is small or limited.

23 Claims, 9 Drawing Sheets

HEAT EXCHANGER

BACKGROUND OF THE INVENTION

1. Field of the Invention

The present invention relates to a heat exchanger, and more specifically relates to a heat exchanger which is required to be installed in a small limited space such as a condenser used in an air conditioner for vehicles.

2. Description of the Prior Art

A conventional heat exchanger for use as a condenser in an automobile is constructed, for example, as shown in FIGS. 15 and 16. The heat exchanger has a pair of header pipes 1 and 2 extending in parallel relation with each other, and a plurality of flat heat-transfer tubes 3 disposed between the header pipes in parallel relation with one another and connected to the header pipes at their end portions. A plurality of radiation fins 4 are provided between flat heat-transfer tubes 3 to accelerate the radiation from the flat heat-transfer tubes. An inlet tube 5 is connected to the end portion of header pipe 1 for introducing a cooling medium into the heat exchanger and an outlet tube 6 is connected to the end portion of header pipe 2 for delivering the condensed cooling medium from the heat exchanger to other equipment.

The insides of header pipes 1 and 2 are divided into a plurality of spaces in their axial directions by partitions 7 and 8, respectively. The cooling medium introduced through inlet tube 5 flows in a serpentine passage through header pipes 1 and 2 and flat heat-transfer tubes 3 until the heat exchanged and condensed cooling medium flows out from outlet tube 6. The cross-sectional areas of the upstream portion and the downstream portion in the serpentine passage can be easily adjusted by repositioning partitions 7 and 8. In the heat exchanger shown in FIG. 16, partitions 7 and 8 are positioned so that the cooling medium flows through relatively many flat heat-transfer tubes 3 in its upstream portion and through relatively few flat heat-transfer tubes 3 in its downstream portion.

Such a heat exchanger can be used for a condenser of an air conditioner for an automobile. The space in an automobile for the installation of a condenser is usually limited to various shapes other than a rectangle. On the other hand, the front shape of the heat exchanger shown in FIGS. 15 and 16 is a rectangle. Therefore, if this heat exchanger is used as a condenser of an air conditioner for an automobile, a relatively large vacant space or spaces are formed around the heat exchanger. This vacant space does not contribute to the heat exchange of the heat exchanger and is not useful for increasing the effectiveness of the heat exchanger at all. Namely, the air flowable area of the heat exchanger for its heat exchange is reduced by the area of the vacant space.

SUMMARY OF THE INVENTION

Accordingly, an object of the present invention is to provide a heat exchanger which can make a useless vacant space formed around the heat exchanger as small as possible and make the air flowable area of the heat exchange portion of the heat exchanger as large as possible according to the shape of a space for the installation of the heat exchanger, and thereby increase the effectiveness of the heat exchanger.

To achieve this object, a heat exchanger according to the present invention is herein provided. The heat exchanger comprises a pair of header pipes extending in parallel relation with each other; a plurality of flat heat-transfer tubes disposed between the pair of header pipes in parallel relation with one another and connected to the pair of header pipes at their end portions; a plurality of radiation fins provided on the sides of the flat heat-transfer tubes; an additional flat heat-transfer tube disposed adjacent to an end flat heat-transfer tube of the plurality of flat heat-transfer tubes, the additional flat heat-transfer tube having a path cross-sectional area larger than those of the flat heat-transfer tubes, one end portion of the additional flat heat-transfer tube being connected to an end portion of one of the pair of header pipes and the other end portion of the additional flat heat-transfer tube being connected to a joint unit for connecting the additional flat heat-transfer tube to other equipment; and an additional radiation fin provided on at least one side of the additional flat heat-transfer tube.

In the heat exchanger, the additional flat heat-transfer tube and the additional radiation fin constitute an additional heat exchange portion of the heat exchanger. This additional heat exchange portion can be formed as various shapes and various sizes according to the space for the installation of the heat exchanger. Therefore, even if the space for the installation is a small and limited space, such as a space for a condenser of an air conditioner for an automobile which has a shape other than a rectangle, a projected portion or a corner portion of the space can be utilized as an additional heat exchange portion formed by the additional flat heat-transfer tube and the additional radiation fin. As a result, the heat exchanger can have an air flowable area larger than that of a merely rectangular shaped heat exchanger, to thereby increase the effectiveness of the heat exchanger.

Although the path for a heat medium (for example, cooling medium) in the heat exchanger is usually formed by a plurality of the flat heat-transfer tubes, the path at the portion of the additional flat heat-transfer tube is formed basically by a single additional flat heat-transfer tube. Nevertheless, since the additional flat heat-transfer tube has a path cross-sectional area larger than those of other the flat heat-transfer tubes, an undue loss of pressure of the heat medium is prevented.

BRIEF DESCRIPTION OF THE DRAWINGS

Some preferred exemplary embodiments of the invention will now be described with reference to the accompanying drawings which are given by way of example only, and thus are not intended to limit the present invention.

DETAILED DESCRIPTION OF PREFERRED EMBODIMENTS OF THE INVENTION

Figure 1:
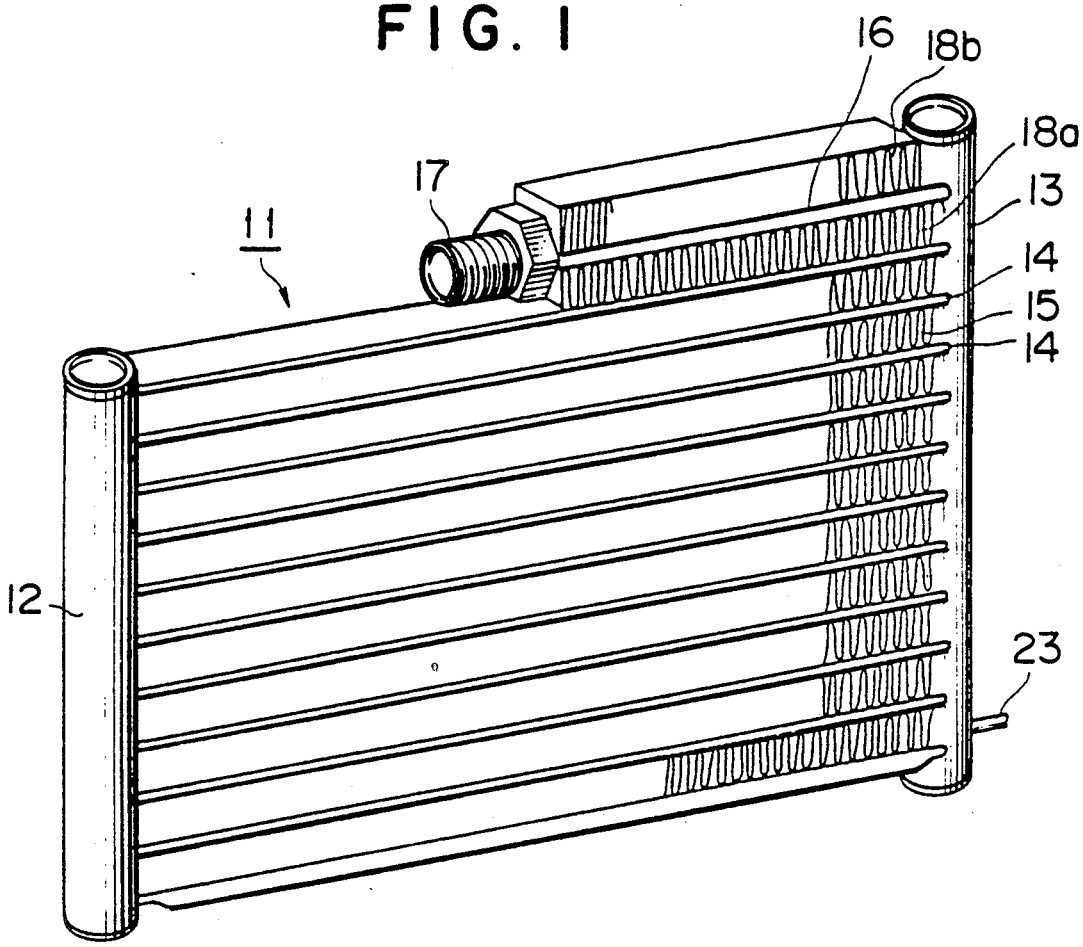
FIG. 1 is a perspective view of a heat exchanger according to a first embodiment of the present invention.

Referring to the drawings, FIGS. 1–3 and FIG. 5 illustrate a heat exchanger according to a first embodiment of the present invention. In FIG. 1, a heat exchanger 11 has a pair of header pipes 12 and 13 in parallel relation with each other, a plurality of flat heat-transfer tubes 14 in parallel relation with one another and connected to the header pipes at their end portions, and a plurality of radiation fins 15 disposed on the sides of the flat heat-transfer tubes.

An additional flat heat-transfer tube 16 is provided adjacent to the end (top) flat heat-transfer tube 14. In this embodiment, additional flat heat-transfer tube 16 is straight, extends in parallel relation to the end flat heat-transfer tube 14, and is provided on the entrance side for the cooling medium. One end portion of additional flat heat-transfer tube 16 is connected to header pipe 13 and the other end portion thereof is connected to a joint unit 17 as an inlet for the cooling medium.

Additional radiation fins 18*a* and 18*b* having substantially the same shape are provided on both sides of additional flat heat-transfer tube 16, respectively, in this embodiment. These additional radiation fins 18*a* and 18*b* and radiation fins 15 are constructed as corrugate fins. Additional radiation fin 18*a* is fixed to the upper surface of the end flat heat-transfer tube 14 by, for example, brazing. Additional flat heat-transfer tube 16 is fixed to additional radiation fin 18*a* by, for example, brazing.

Figure 2:
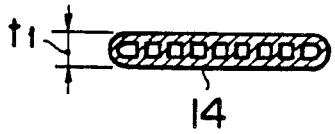
FIG. 2 is an enlarged cross-sectional view of a flat heat-transfer tube of the heat exchanger shown in FIG. 1.
Figure 3:
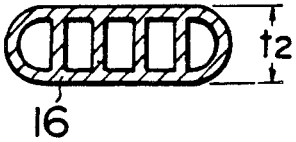
FIG. 3 is an enlarged cross-sectional view of an additional flat heat-transfer tube of the heat exchanger shown in FIG. 1.
Figure 4:
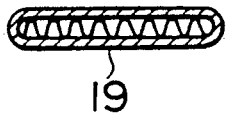
FIG. 4 is a cross-sectional view of a flat heat-transfer tube or an additional flat heat-transfer tube modified from the tube shown in FIG. 2 or FIG. 3.

Flat heat-transfer tubes 14 have a cross section having a thickness of t1 as shown in FIG. 2. Additional flat heat-transfer tube 16 has a cross section having a thickness of t2 greater than t1 as shown in FIG. 3. Therefore, the path cross-sectional area of additional flat heat-transfer tube 16 is larger than those of flat heat-transfer tubes 14. The structure and configuration of the cross section of flat heat-transfer tube 14 or additional flat heat-transfer tube 16 may be constructed as the structure and configuration of a tube 19 shown in FIG. 4.

Figure 5:
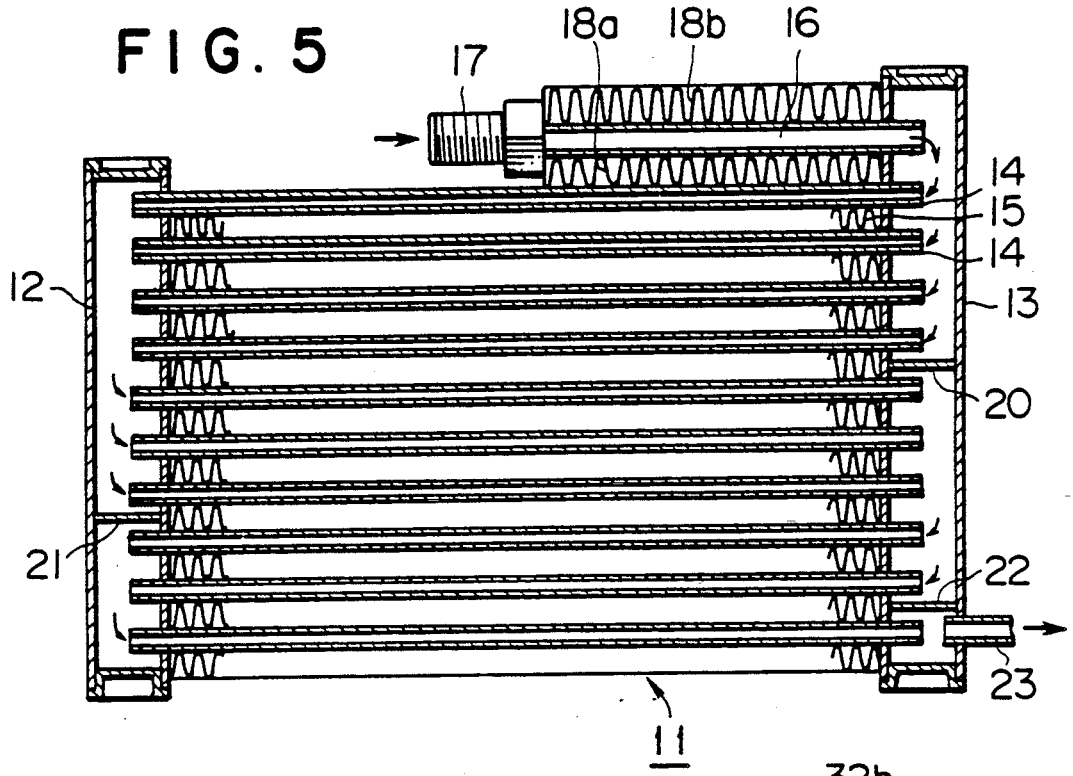
FIG. 5 is a vertical sectional view of the heat exchanger shown in FIG. 1.

As shown by arrows in FIG. 5, the cooling medium is introduced from the opening of joint unit 17 into additional flat heat-transfer tube 16. The cooling medium is condensed by the radiation from the surface of additional flat heat-transfer tube 16 during passage through the tube. Additional radiation fins 18*a* and 18*b* accelerate this radiation. Thereafter, the cooling medium flows into header pipe 13, turns by a partition 20 and flows into a plurality of flat heat-transfer tubes 14. The cooling medium flows into header pipe 12, turns by a partition 21 and flows into a plurality of flat heat-transfer tubes 14. The cooling medium flows again into header pipe 13, turns by a partition 22 and flows into flat heat-transfer tubes 14. Finally, the cooling medium flows out from header pipe 13 through an outlet tube 23 to another piece of equipment, such as, a liquid box or a reserve tank (not shown). During this passage, the cooling medium is gradually condensed by radiation. Although the positions of partitions 20, 21 and 22 can be freely set, the positions are desirably set such that the number of flat heat-transfer tubes 14 having the same directional parallel flow of the cooling medium is gradually decreased from the upstream side to the downstream side.

In the above heat exchanger, additional flat heat-transfer tube 16 and additional radiation fins 18*a* and 18*b* constitute an additional heat exchange portion. If this additional heat exchange portion is positioned at an otherwise vacant space in the space for installation of the heat exchanger, the vacant space can be utilized as an additional heat exchange portion. This construction increases the heat exchange ability of the heat exchanger by the additional heat exchange portion. In other words, the air flowable area for radiation of the heat exchanger can be efficiently increased by the additional heat exchange portion, which in turn increases the effectiveness of the heat exchanger to an great extent.

Moreover, since the path cross-sectional area of additional flat heat-transfer tube 16 is larger than those of flat heat-transfer tubes 14, an increase of the pressure loss of the heat exchanger can be limited to a very small amount, despite the addition of the single additional flat heat-transfer tube.

Figure 6:
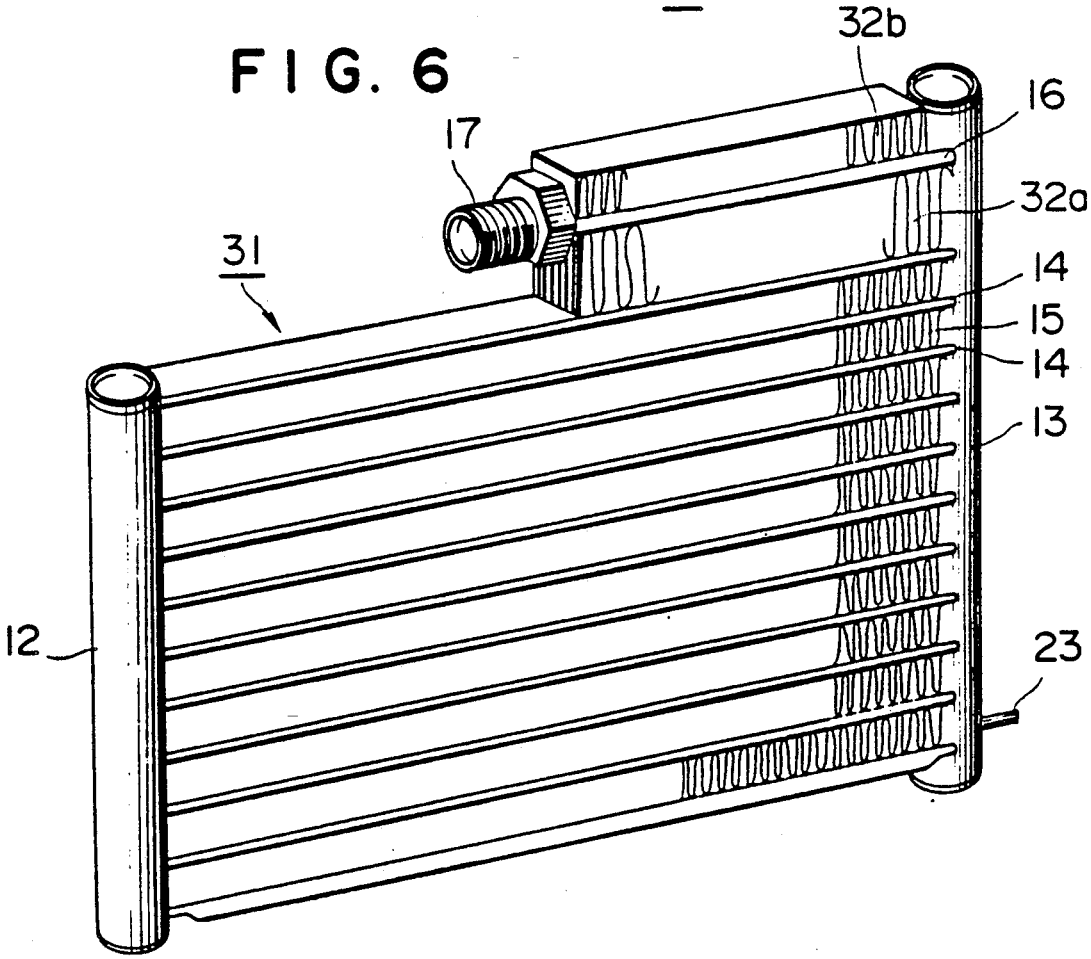
FIG. 6 is a perspective view of a heat exchanger modified from the heat exchanger shown in FIG. 1.

FIG. 6 illustrates a modification of the heat exchanger shown in FIG. 1. In this heat exchanger 31, a lower additional radiation fin 32*a* and an upper additional radiation fin 32*b* are formed as different shapes from each other. Thus, additional radiation fins are freely designed and the height of the position of joint unit 17 in the vertical direction from the end flat heat-transfer tube 14 can be freely set to a desired height as needed. Other components are substantially the same as those shown in FIG. 1.

Figure 7:
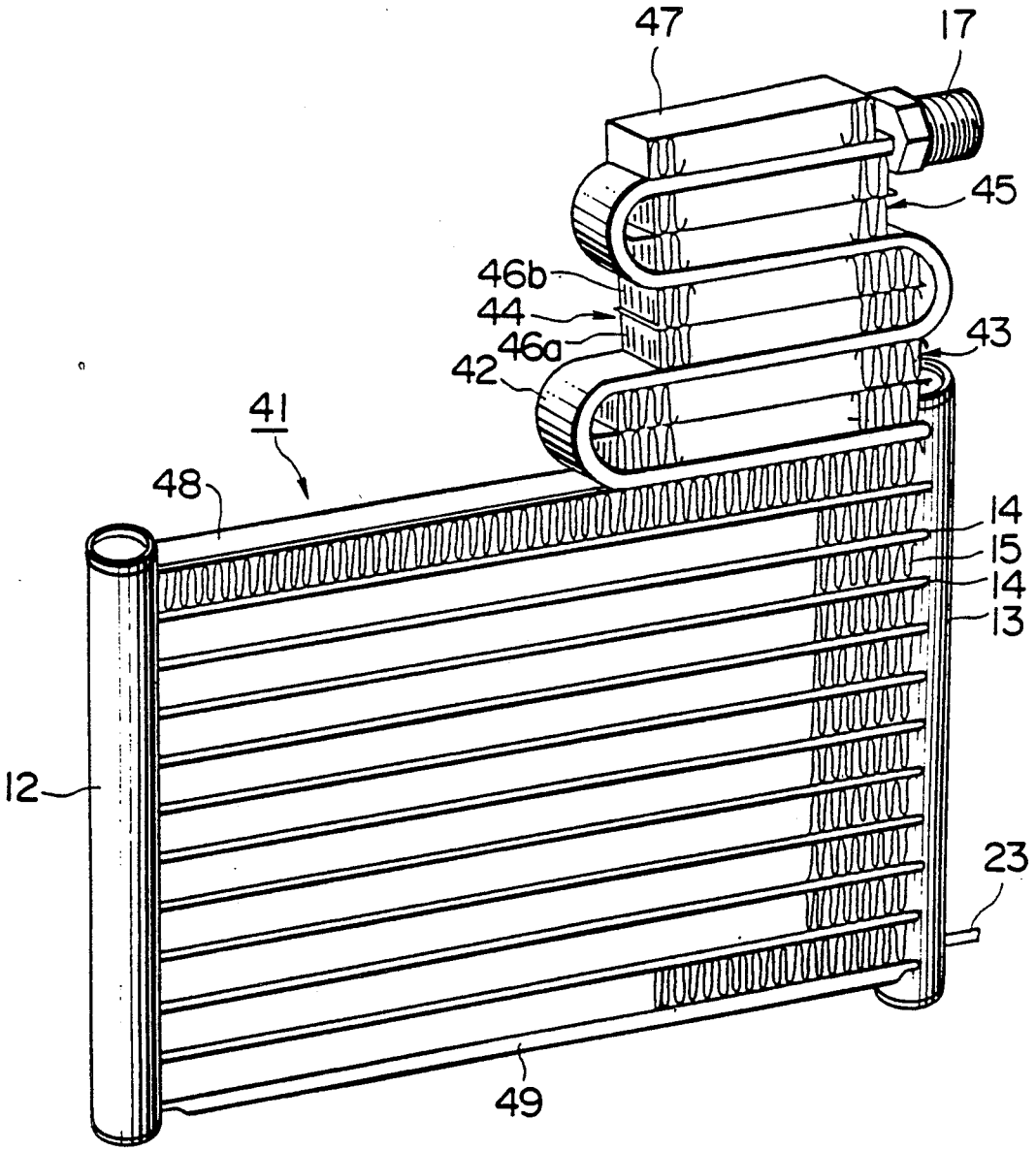
FIG. 7 is a perspective view of a heat exchanger according to a second embodiment of the present invention.

FIG. 7 illustrates a heat exchanger 41 according to a second embodiment of the present invention. In this embodiment, an additional flat heat-transfer tube 42 is formed as a serpentine tube. The serpentine additional flat heat-transfer tube 42 has a plurality of portions extending in parallel relation with each other and in parallel relation with the end flat heat-transfer tube 14. Additional radiation fins 43, 44 and 45 are disposed between the parallel portions. Additional radiation fins 43, 44 and 45 are constructed as a lamination of fins 46*a* and 46*b* in this embodiment. Further, an outermost additional radiation fin 47 is provided on the top surface of the serpentine additional flat heat-transfer tube 42. Thus, the shape of the additional flat heat-transfer tube is not particularly restricted, and the entire size or the height thereof is freely designed. In this embodiment, a side plate 48 is provided on the top of the top radiation fin 15 and a side plate 49 is provided on the bottom of the bottom radiation fin 15. In the embodiment shown in FIG. 7, fins having the same size as those of radiation fins 15 are used as additional radiation fins 46*a* and 46*b*.

Figure 8:
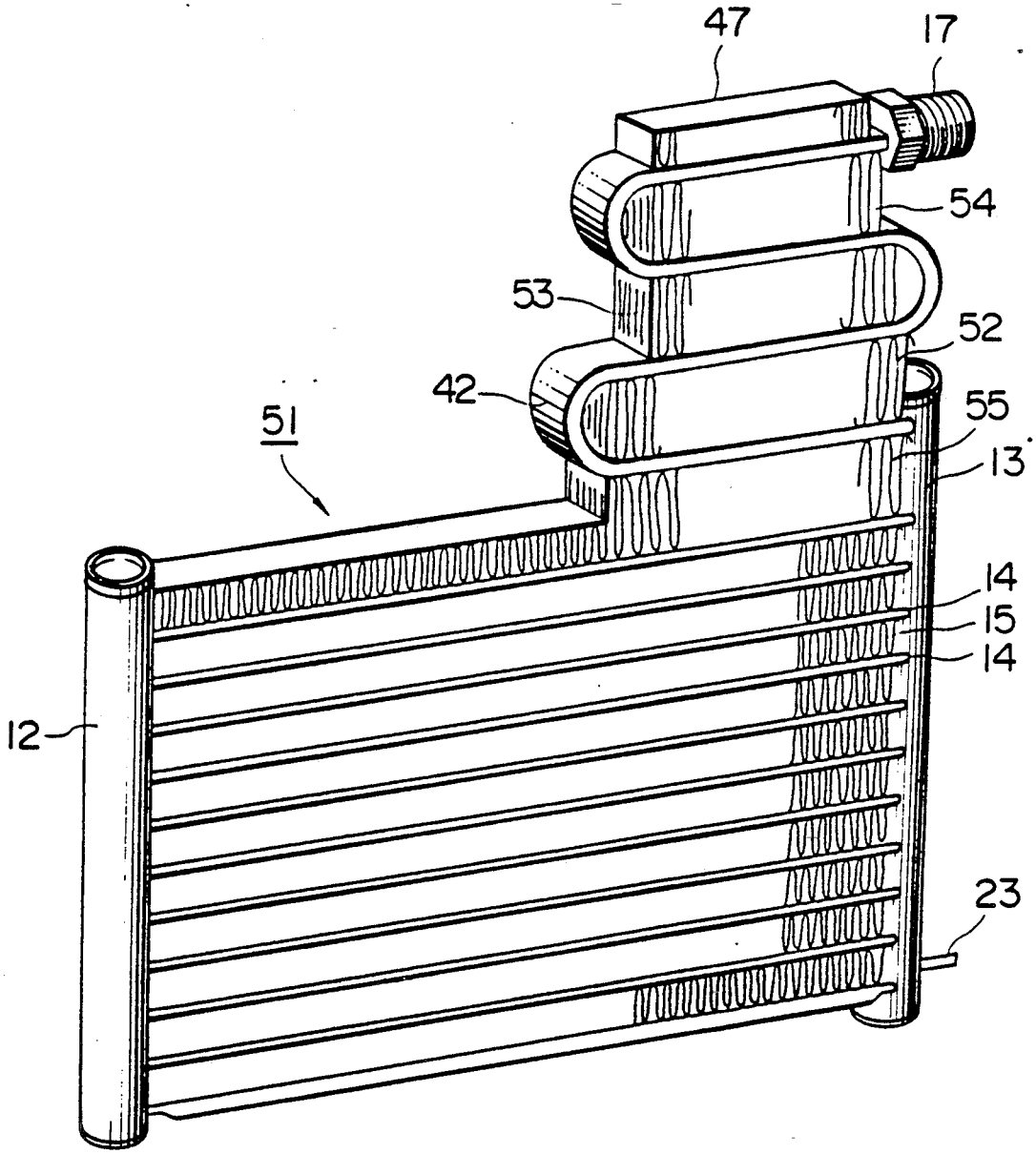
FIG. 8 is a perspective view of a heat exchanger modified from the heat exchanger shown in FIG. 7.

FIG. 8 illustrates a modification of the heat exchanger shown in FIG. 7. In a heat exchanger 51 of this embodiment, additional radiation fins 52, 53 and 54 are constructed as single-layer fins. A part 55 of the top end radiation fin is formed as a fin portion having the height higher than the other portion of the radiation fin. In this embodiment, the heights of additional radiation fins 52, 53 and 54 can be freely designed.

Figure 9:
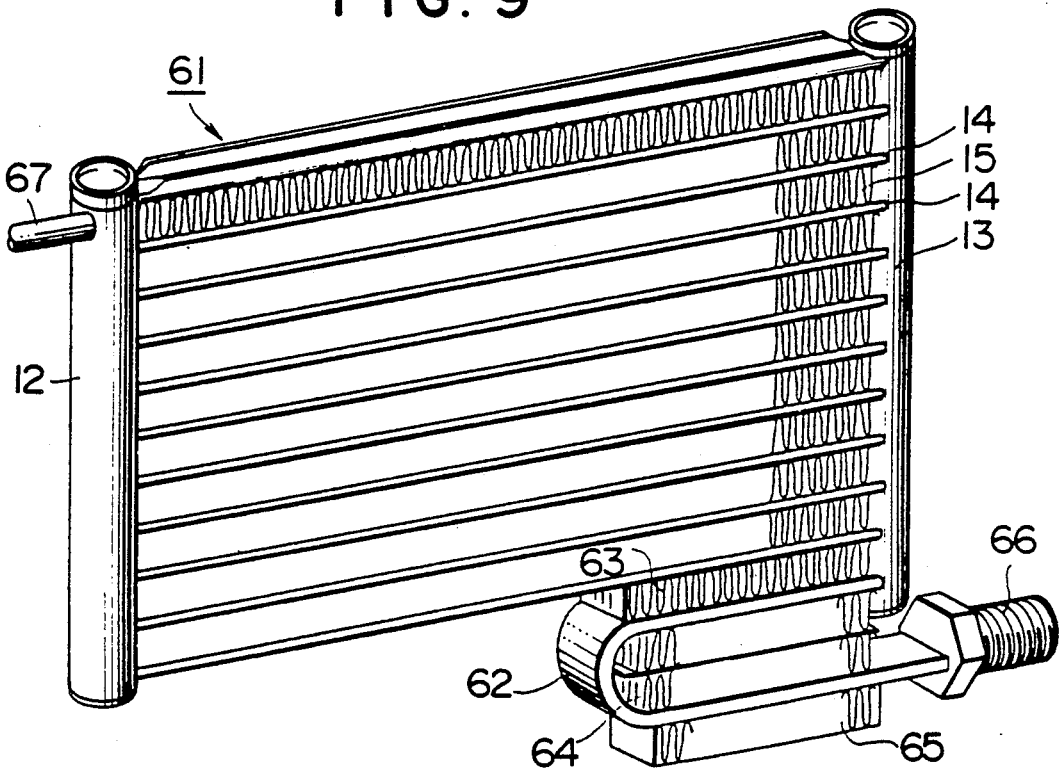
FIG. 9 is a perspective view of a heat exchanger according to a third embodiment of the present invention.

FIG. 9 illustrates a heat exchanger 61 according to a third embodiment of the present invention. In this embodiment, an additional flat heat-transfer tube (serpentine type) 62 and additional radiation fins 63, 64 and 65 are provided on the exit side for the cooling medium of the heat exchanger. A joint unit 66, connected to another piece of equipment for delivering the condensed cooling medium to the equipment, is connected to the end of additional flat heat-transfer tube 62. A inlet tube 67 is provided on header pipe 12 for introducing the cooling medium into the header pipe. Thus, an additional flat heat-transfer tube and either a single or a plurality of additional radiation fins may be provided on the exit side of the heat exchanger.

Figure 10:
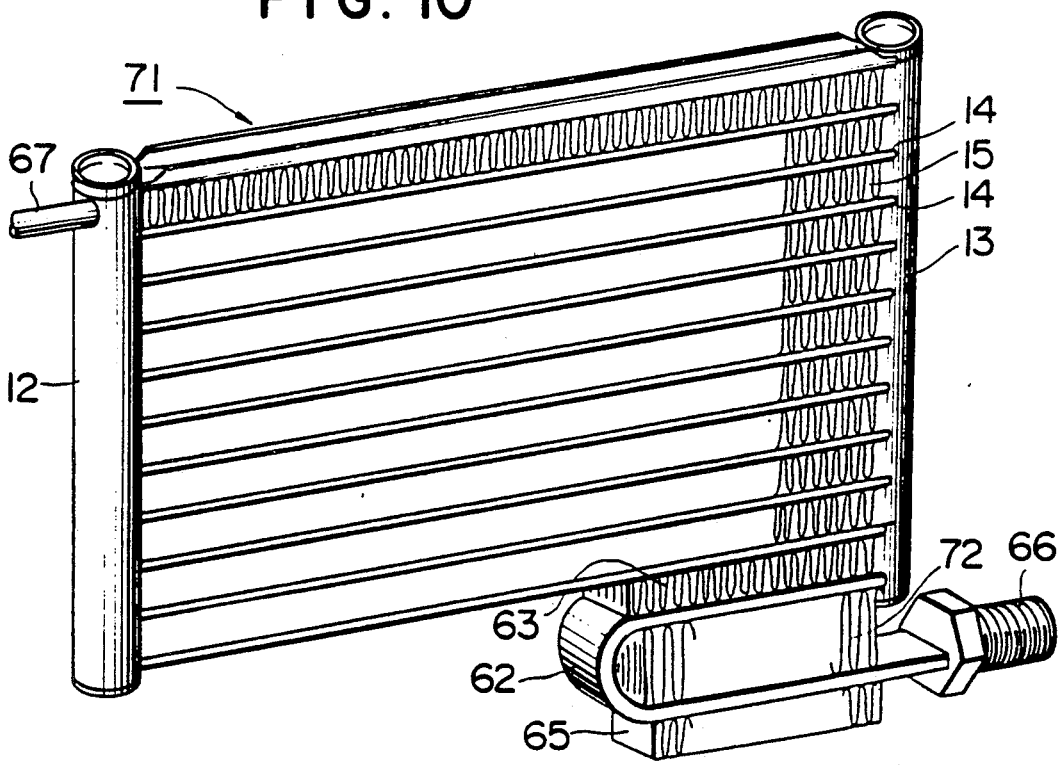
FIG. 10 is a perspective view of a heat exchanger modified from the heat exchanger shown in FIG. 9.

FIG. 10 illustrates a modification of the heat exchanger shown in FIG. 9. In a heat exchanger 71 of this embodiment, an additional radiation fin 72 between the parallel portions of additional flat heat-transfer tube 62 is constructed as a single layer of fin.

Figure 11:
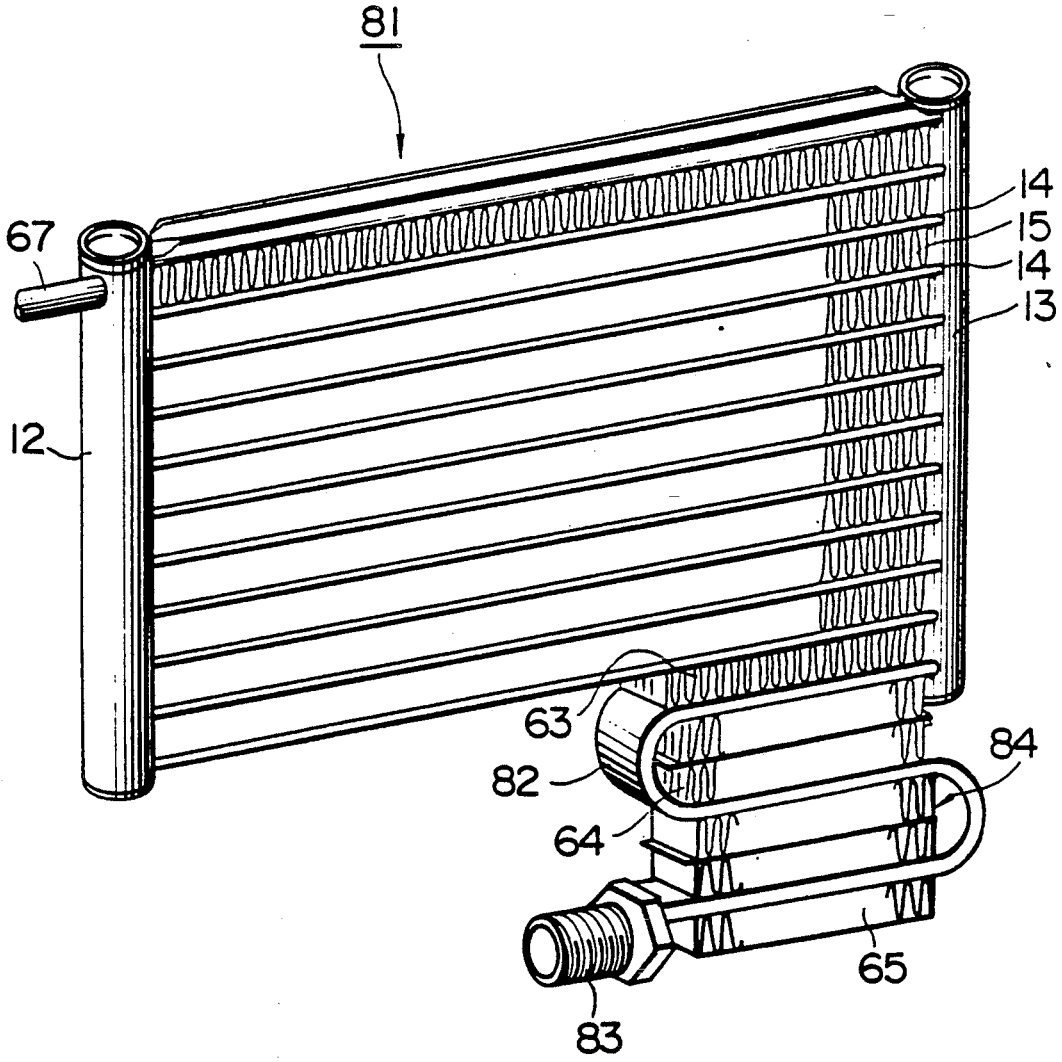
FIG. 11 is a perspective view of a heat exchanger according to another modification of the heat exchanger shown in FIG. 9.

FIG. 11 illustrates another modification of the heat exchanger shown in FIG. 9. In a heat exchanger 81 of this embodiment, the end portion of a serpentine additional flat heat-transfer tube 82 is positioned at a central portion between the pair of header pipes 12 and 13, and a joint unit 83 is connected to this end portion. Therefore, the joint unit 83 is also positioned at the central portion between header pipes 12 and 13. An additional radiation fin 84 is added in the heat exchanger. Thus, the position of a joint unit can be freely designed as needed for connection with other equipment.

Figure 12:
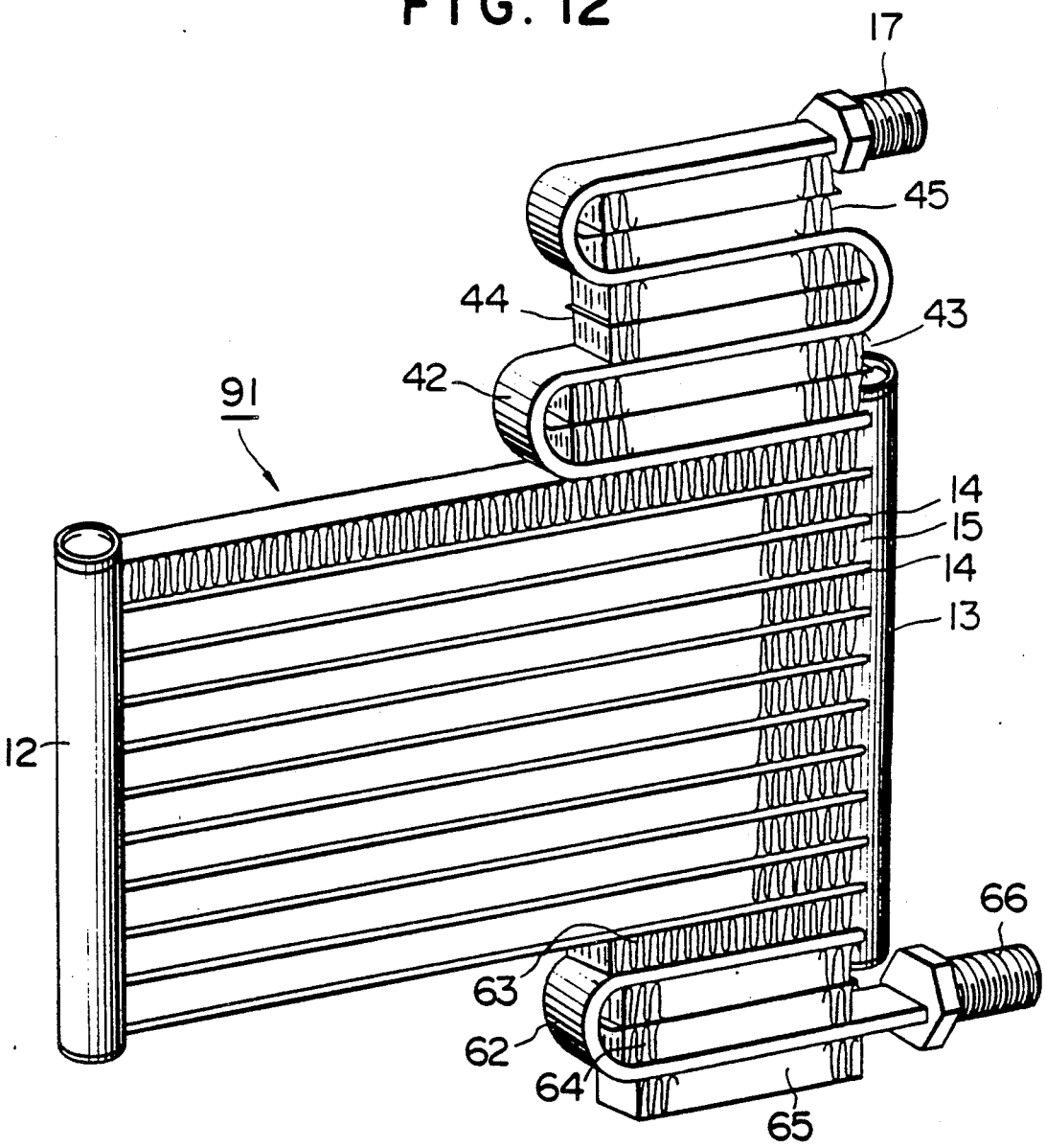
FIG. 12 is a perspective view of a heat exchanger according to a fourth embodiment of the present invention.

FIG. 12 illustrates a heat exchanger 91 according to a fourth embodiment of the present invention. This embodiment is a combination of the embodiments shown in FIGS. 7 and 9. Namely, additional flat heat-transfer tubes 42 and 62 and additional radiation fins 43–45 and 63–65 are provided on both the entrance and exit sides of the heat exchanger. This construction enables both of the vacant spaces in the entrance and exit sides of the space for installation of the heat exchanger to be efficiently utilized for increasing the effectiveness of the heat exchanger.

Figure 13:
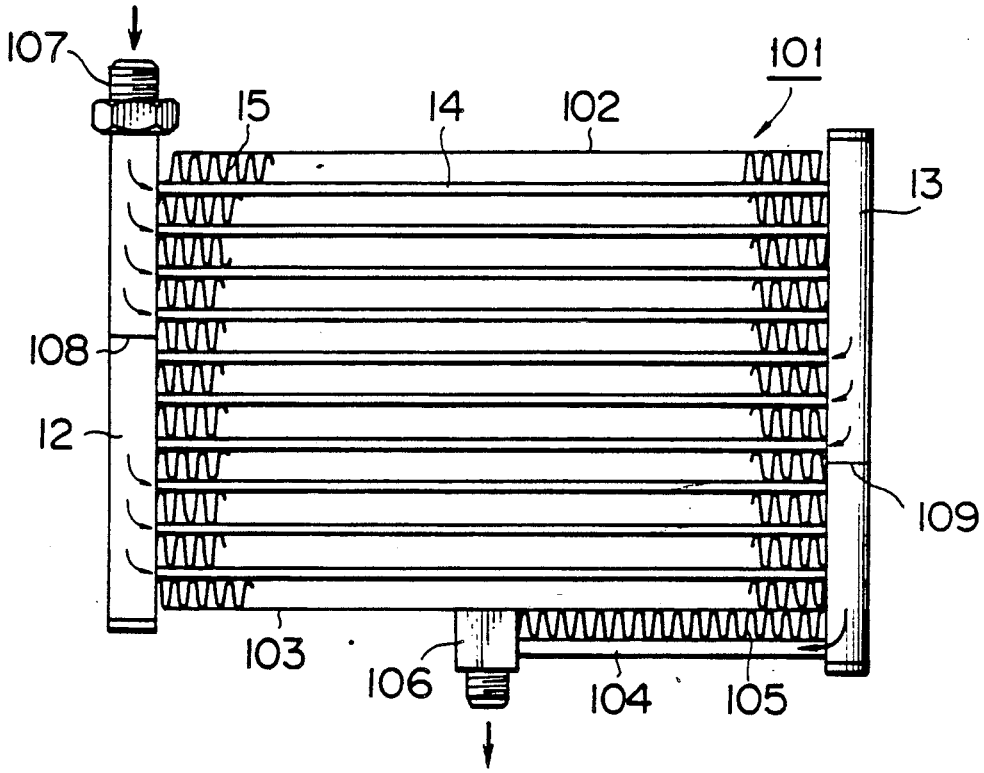
FIG. 13 is elevational view of a heat exchanger according to a fifth embodiment of the present invention.
Figure 14:
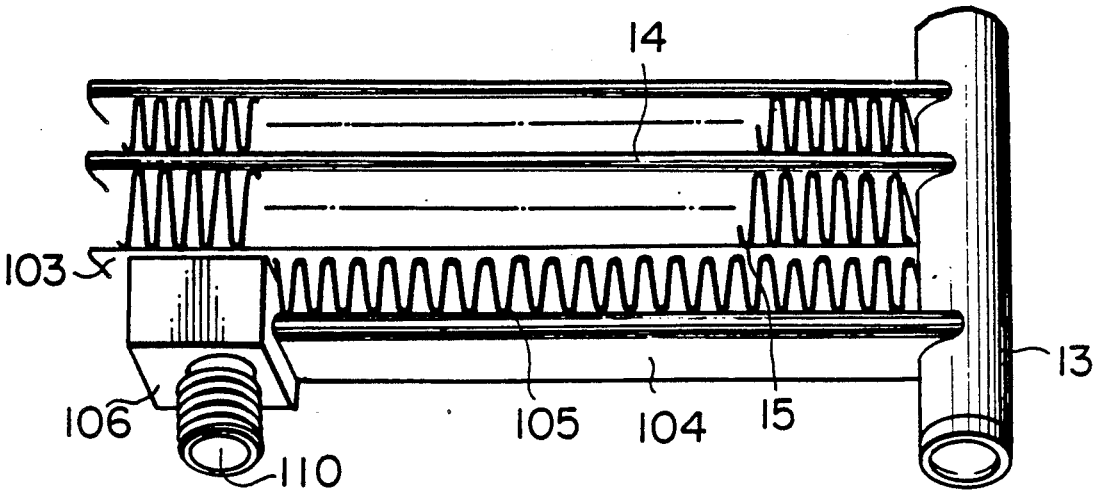
FIG. 14 is an enlarged partial perspective view of the heat exchanger shown in FIG. 13.
Figure 15:
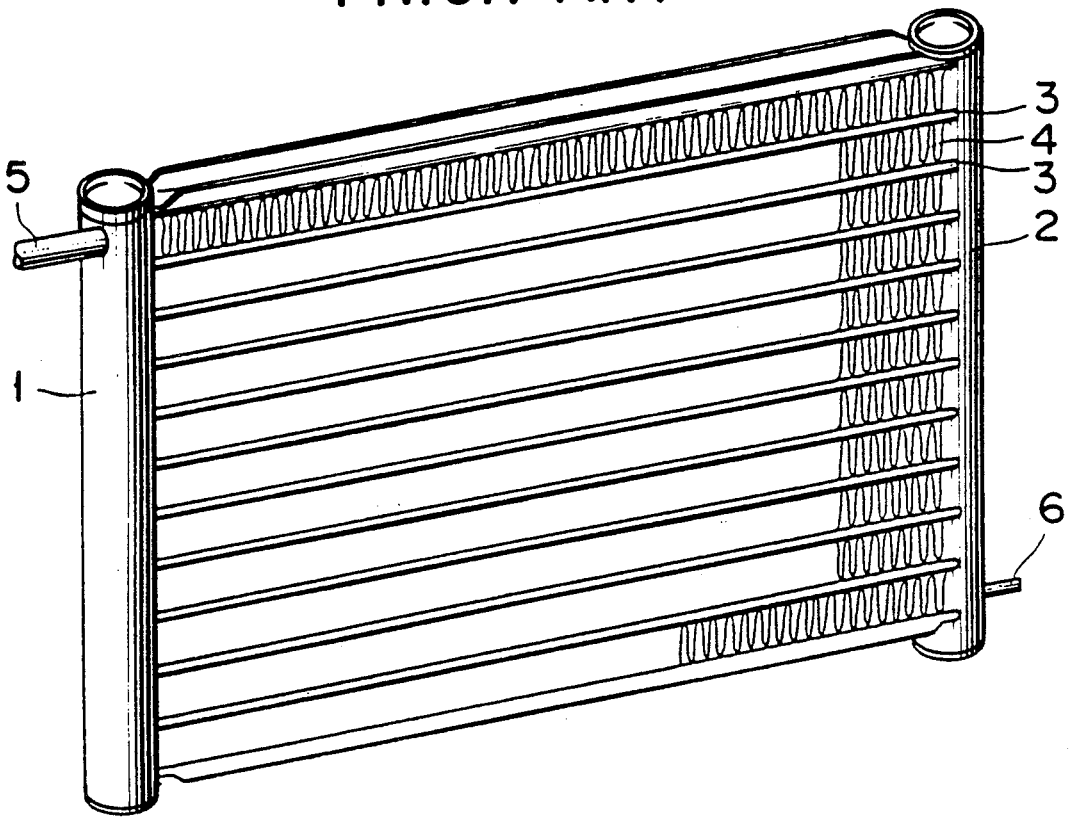
FIG. 15 PRIOR ART
FIG. 15 is a perspective view of a conventional heat exchanger.
Figure 16:
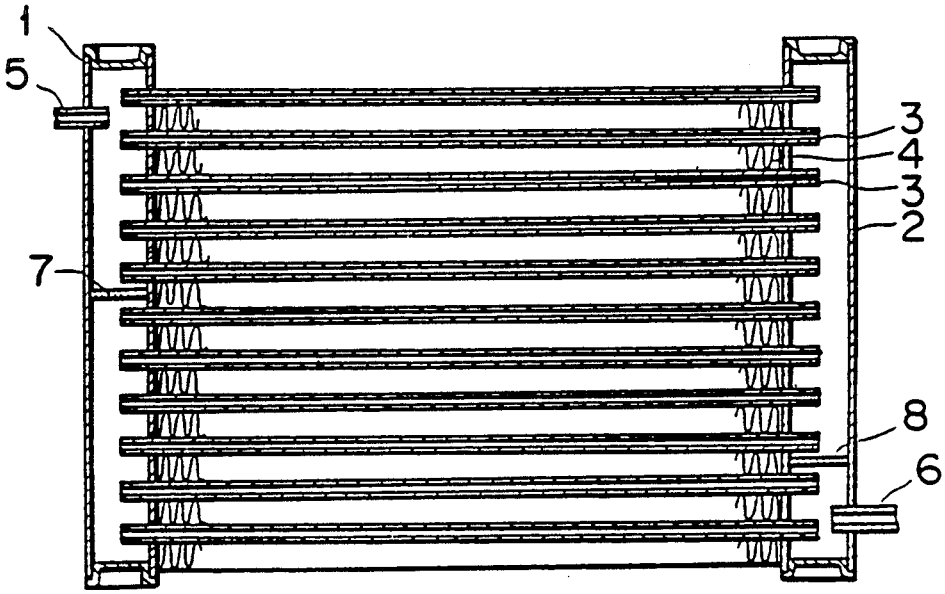
FIG. 16 PRIOR ART
FIG. 16 is a vertical sectional view of the heat exchanger shown in FIG. 15.

FIGS. 13 and 14 illustrate a heat exchanger 101 according to a fifth embodiment of the present invention. In this embodiment, heat exchanger 101 has side plates 102 and 103. Further, an additional flat heat-transfer tube 104, an additional radiation fin 105 and a joint unit 106 are provided on the bottom side plate 103. The heat exchanger also has a inlet joint unit 107 on the top of header pipe 12 and partitions 108 and 109 in header pipes 12 and 13. The arrows in FIG. 13 show the flow of the cooling medium in this heat exchanger. Preferably, additional radiation fin 105 is fixed to side plate 103 by brazing and additional flat heat-transfer tube 104 is fixed to the additional radiation fin by brazing. Joint unit 106 may also be fixed to side plate 103 by brazing. Of course other means of attaching can be used beside brazing. If joint unit 106 is fixed to side plate 103, the structure of the additional heat exchange portion can possess increased rigidity and strength. Although the joint units open in a direction parallel to the extending direction of the flat heat-transfer tubes in the aforementioned embodiments, the direction of the opening 110 of joint unit 106 is set to a direction perpendicular to the extending direction of flat heat-transfer tubes 14 in this embodiment. Thus, the opening direction of the joint unit can be freely changed.

Although several preferred embodiments of the present invention have been described herein in detail, it will be appreciated by those skilled in the art that various modifications and alterations can be made to these embodiments without materially departing from the novel teachings and advantages of this invention. Accordingly, it is to be understood that all such modifications and alterations are included within the scope of the invention a defined by the following claims.

What is claimed is:

1. A heat exchanger comprising:

a pair of header pipes extending in parallel relation with each other;

a plurality of flat heat-transfer tubes, each defining a plurality of end portions and a plurality of sides, disposed between said pair of header pipes in parallel relation with one another and connected to said pair of header pipes at their end portions;

a plurality of radiation fins provided on the sides of said flat heat-transfer tubes;

an additional flat heat-transfer tube disposed adjacent to an end flat heat-transfer tube of said plurality of flat heat-transfer tubes, said additional flat heat-transfer tube defining a path having a cross-sectional area larger than those of said flat heat-transfer tubes, only one end portion of said additional flat heat-transfer tube being connected to an end portion of a header pipe, the other end portion of said additional flat heat-transfer tube being connected to a joint unit for connecting said additional flat heat-transfer tube to other equipment; and an additional radiation fin provided on at least one side of said additional flat heat-transfer tube.

2. The heat exchanger according to claim 1, wherein the thickness of said additional flat heat-transfer tube is greater than those of said flat heat-transfer tubes.

3. The heat exchanger according to claim 1, wherein a pair of additional radiation fins are provided such that said additional radiation fins are provided on opposite sides of said additional flat heat-transfer tube.

4. The heat exchanger according to claim 3, wherein said additional radiation fin provided on one side of said additional flat heat-transfer tube and said additional radiation fin provided on the other side thereof are substantially the same shape.

5. The heat exchanger according to claim 3, wherein said additional radiation fin provided on one side of said additional flat heat-transfer tube and said additional radiation fin provided on the other side thereof are formed as different shapes.

6. The heat exchanger according to claim 1, wherein said additional radiation fin is disposed between said additional flat heat-transfer tube and said end flat heat-transfer tube.

7. The heat exchanger according to claim 1, which further includes an entrance side and an exit side for passage of a cooling medium and wherein said additional flat heat-transfer tube is provided on one side of the entrance and exit sides of the heat exchanger.

8. The heat exchanger according to claim 1, which further includes an entrance side and an exit side for passage of a cooling medium and wherein a pair of additional flat heat-transfer tubes are provided such that one of said additional flat heat-transfer tubes is provided on each of the entrance and exit sides of the heat exchanger.

9. The heat exchanger according to claim 1, wherein said additional flat heat-transfer tube is formed as a serpentine tube.

10. The heat exchanger according to claim 9, wherein said serpentine additional flat heat-transfer tube has portions extending in parallel relation with said flat heat-transfer tubes and said additional radiation fin is further provided between the portions.

11. The heat exchanger according to claim 10, wherein said additional radiation fin between said portions is constructed of a single layer of fin.

12. The heat exchanger according to claim 10, wherein said additional radiation fin between said portions is constructed as a lamination of a plurality of fins.

13. The heat exchanger according to claim 1, wherein said additional radiation fin is fixed to said end flat heat-transfer tube and said additional flat heat-transfer tube is fixed to said additional radiation fin.

14. The heat exchanger according to claim 1 further comprising a side plate provided on at least one of the outermost layers of said flat heat-transfer tubes and said radiation fins.

15. The heat exchanger according to claim 14, wherein said additional flat heat-transfer tube and said additional radiation fin are disposed on said side plate.

16. The heat exchanger according to claim 15, wherein said additional radiation fin is fixed to said side plate and said additional flat heat-transfer tube is fixed to said additional radiation fin.

17. The heat exchanger according to claim 14, wherein said joint unit is fixed to said side plate.

18. The heat exchanger according to claim 14, wherein said joint unit is disposed at a central position between said pair of header pipes and said joint unit is fixed to said side plate.

19. The heat exchanger according to claim 1, wherein said joint unit is disposed at a central position between said pair of header pipes.

20. The heat exchanger according to claim 1, wherein said joint unit opens in a direction parallel to the extending direction of said flat heat-transfer tubes.

21. The heat exchanger according to claim 1, wherein said joint unit opens in a direction perpendicular to the extending direction of said flat heat-transfer tubes.

22. A heat exchanger for use in a vehicle engine compartment, wherein the engine compartment provides an irregular finite space through which air flows and in which the heat exchanger is received, the heat exchanger comprising:

a pair of header pipes extending generally parallel to one another and defining a space therebetween;

a plurality of first heat transfer tubes each extending completely across the space defined between said header pipes and being fluidly connected with each of said header pipes, said first heat transfer tubes being positioned within the air flow to generate an effective heat transfer between the air and a heat medium flowing through the heat exchanger, and said first heat transfer tubes each further defining a first cross-sectional area;

a plurality of radiation fins attached to the first heat transfer tubes;

a second heat transfer tube extending only partially across the space between said header pipes in order to maximize the use of the finite irregular space in said engine compartment, said second heat transfer tube being positioned in said air flow to facilitate effective heat transfer between the air and the heat medium, said second heat transfer tube defining a second cross-sectional area which is larger than the first cross-sectional area of said first heat transfer tubes, and said second heat transfer tube having only one end fluidly coupled to a header pipe, an opposite end thereof being fluidly coupled to other equipment; and a second radiation fin provided on at least one side of said second heat transfer tube.

23. In an engine compartment for a vehicle, wherein the engine compartment provides a finite irregular space for receiving a heat exchanger and through which a satisfactory air flow passes, the improvement including a heat exchanger comprising:

a pair of header pipes extending across the space defined in the engine compartment, said header pipes being spaced apart to define a space therebetween;

a plurality of first heat transfer tubes defining a first cross-sectional area, each first heat transfer tube extending completely across the space defined between said header pipes and being fluidly connected with each of said header pipes, and said first heat transfer tubes being positioned within the air flow to generate an effective heat transfer between the air flow and a heat medium flowing through the heat exchanger;

a plurality of radiation fins attached to said first heat transfer tubes;

a second heat transfer tube defining a second cross-sectional area which is larger than the first cross-sectional area of each of said first heat transfer tubes, said second heat transfer tube being positioned to extend only partially across the space defined between said header pipes to thereby maximize use of the finite irregular space provided in said engine compartment, said second heat transfer tube being further positioned in said air flow to facilitate effective heat transfer between the air flow and the heat medium, and said second heat transfer tube having only one end fluidly coupled to a header pipe, an opposite end thereof being fluidly coupled to other equipment; and a second radiation fin provided on at least one side of said second heat transfer tube.

* * * * *